US006196695B1

(12) United States Patent
Lai

(10) Patent No.: US 6,196,695 B1
(45) Date of Patent: Mar. 6, 2001

(54) STRUCTURE OF A SCREWDRIVER

(76) Inventor: Jung Yuan Lai, PO Box 82-144, Taipei (TW)

( * ) Notice: Subject to any disclaimer, the term of this patent is extended or adjusted under 35 U.S.C. 154(b) by 0 days.

(21) Appl. No.: 09/484,595

(22) Filed: Jan. 18, 2000

(51) Int. Cl.[7] ..... B25B 23/18
(52) U.S. Cl. ..... 362/119; 362/120
(58) Field of Search ..... 362/119, 120

(56) References Cited

U.S. PATENT DOCUMENTS

| | | | | |
|---|---|---|---|---|
| 5,873,648 | * | 2/1999 | Shiao | 362/119 |
| 6,022,121 | * | 2/2000 | Lin | 362/119 |
| 6,050,698 | * | 2/2000 | Lee | 362/120 |
| 6,086,217 | * | 7/2000 | Jau | 362/119 |
| 6,095,659 | * | 8/2000 | Hsu | 362/119 |

* cited by examiner

*Primary Examiner*—Thomas M. Sember
(74) *Attorney, Agent, or Firm*—A & J

(57) ABSTRACT

A screwdriver includes a tubular handle having an open end provided with external threads, and another end of the tubular handle has a hole in which is fitted a rubber pad. A flashlight has an end provided with a pushbutton switch, so that the flashlight is arranged within the tubular handle with the pushbutton switch in contact with the rubber pad. A collar has a first end and a second end. The first end is threadedly engaged with the external threads of the tubular handle. A transparent cylindrical seat snugly fits in the second end of the collar and is formed with a plurality of recesses for receiving bits. A tubular rod extends from a central portion of the seat. The tubular rod has an outer end formed with a hexagonal recess configured to receive any one of the bits. A magnetic telescopic rod fits within the tubular rod and has a lower end snugly engaged with the tubular rod. A cover is engaged with the seat to prevent the bits from dropping out thereof

1 Claim, 8 Drawing Sheets

STRUCTURE OF A SCREWDRIVER

BACKGROUND OF THE INVENTION

1. Field of the Invention

This invention is related to an improvement in the structure of a screwdriver.

2. Description of the Prior Art

The conventional screwdriver (see FIG. 1) is not provided with any lighting means. In a dim environment, the user has to rely solely upon the available light or use a separate lighting device, which is very inconvenient. If the user has to use a separate lighting device, such as a flashlight, in addition to the screwdriver in performing a job, it is very inconvenient. Furthermore, in a working environment that is not very dim or small, if all the lights are turned on, it will be a waste of energy. Hence, a screwdriver with a light (see FIG. 2) has been developed to obviate this drawback. However, such a screwdriver has no extra space for receiving bits thereby causing another problem in use.

Therefore, it is an object of the present invention to provide an improvement in the structure of a screwdriver which can obviate and mitigate the above-mentioned drawbacks.

SUMMARY OF THE INVENTION

This invention is related to an improvement in the structure of a screwdriver.

According to a preferred embodiment of the present invention, screwdriver includes a tubular handle having an open end provided with external threads, another end of the tubular handle having a hole in which is fitted a rubber pad, a flashlight having an end provided with a pushbutton switch, the flashlight being arranged within the tubular handle with the pushbutton switch in contact with the rubber pad, a collar having a first end and a second end, the first end being threadedly engaged with the external threads of the tubular handle, a transparent cylindrical seat snugly fitted in the second end of the collar and formed with a plurality of recesses for receiving bits and a tubular rod extending from a central portion of the seat, the tubular rod having an outer end formed with a hexagonal recess configured to receive any one of the bits, a magnetic telescopic rod fitted within the tubular rod and having a lower end snugly engaged with the tubular rod, and a cover engaged with the seat to prevent the bits from dropping out thereof.

It is the primary object of the present invention to provide an improved screwdriver which can be easily operated.

It is another object of the present invention to provide an improved screwdriver which is practical in use.

It is still another object of the present invention to provide an improved screwdriver which can be rapidly assembled.

It is still another object of the present invention to provide an improved screwdriver which has many different uses.

It is a further object of the present invention to provide an improved screwdriver which is simple in construction.

The foregoing objects and summary provide only a brief introduction to the present invention. To filly appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
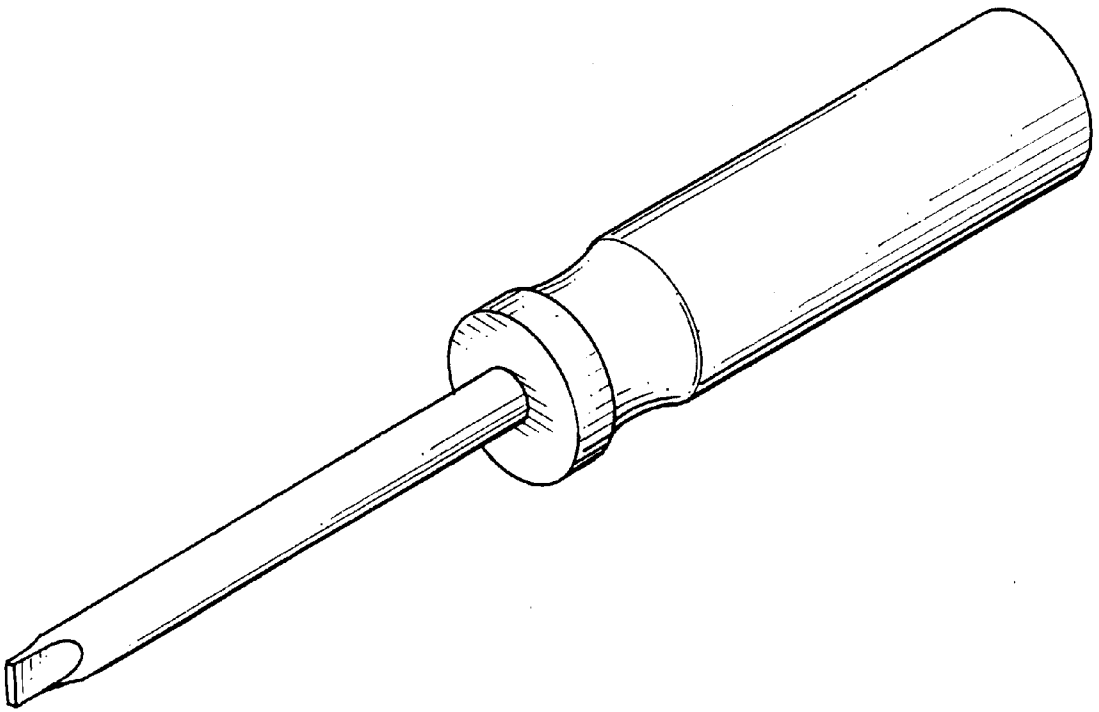
PRIOR ART FIG. 1
FIG. 1 illustrates a first prior art screwdriver.
Figure 2:
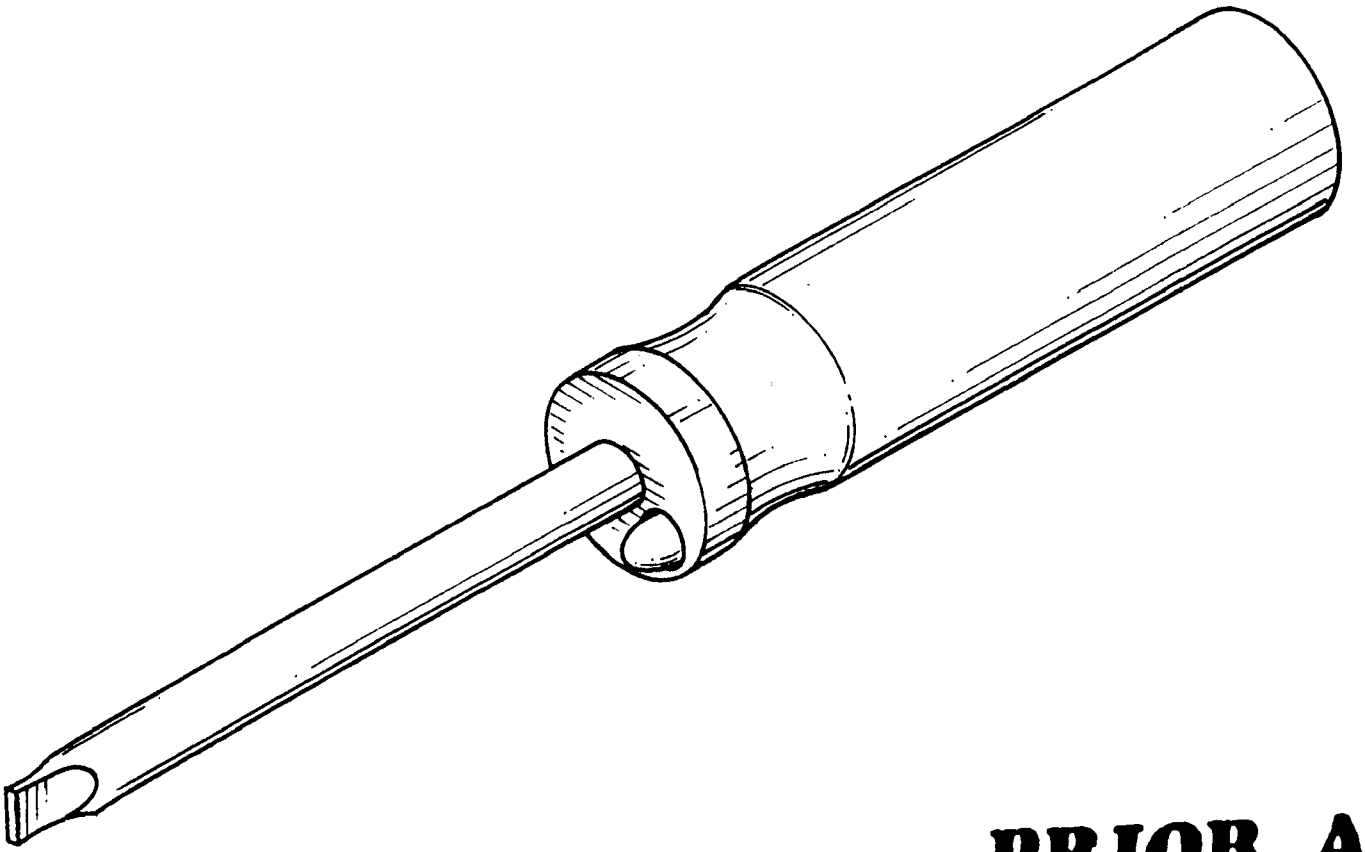
PRIOR ART FIG.2
FIG. 2 illustrates a second prior art screwdriver.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 3:
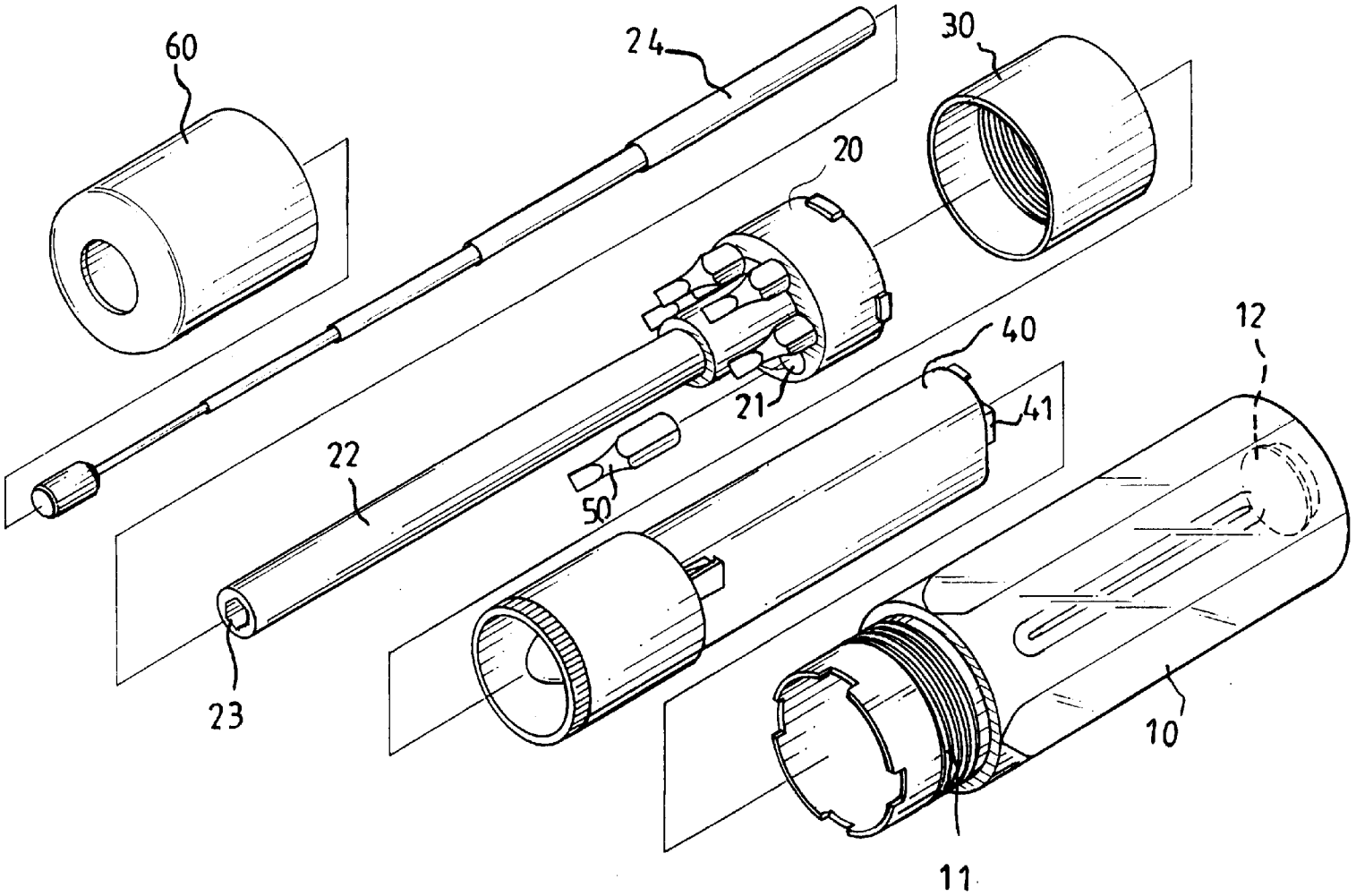
FIG. 3 is an exploded view of the present invention.

With reference to the drawings and in particular to FIG. 3 thereof, the screwdriver according to the present invention generally comprises a handle 10, a seat 20, a collar 30, a flashlight 40, a plurality of bits 50, and a transparent cover 60.

The handle 10 is a tubular member having an open end provided with external threads 11 engageable with the transparent cover 60. Another end of the handle 10 has a hole in which is fitted a rubber pad 12. The flashlight 40 has a pushbutton switch 41 at the end. The flashlight 40 is disposed within the handle 10 with the pushbutton switch 41 in contact with the rubber pad 12 so that when the pushbutton switch 41 is depressed, the flashlight 40 will be turned on or off.

The seat 20 is a transparent cylindrical member formed with a plurality of recesses 21 for receiving the bits 50 and a tubular rod 22 extending from the central portion of the seat 20. The tubular rod 22 has an outer end formed with a hexagonal recess 23 configured to receive a bit 50. A magnetic telescopic rod 24 is fitted within the tubular rod 22 so that the magnetic telescopic rod 24 can keep the bit 50 in place and can extend out of the tubular rod 22 to attract bits 50. The transparent cover 60 is engaged with the seat 20 for preventing the bits 50 from dropping out of the seat 20.

Figure 4:
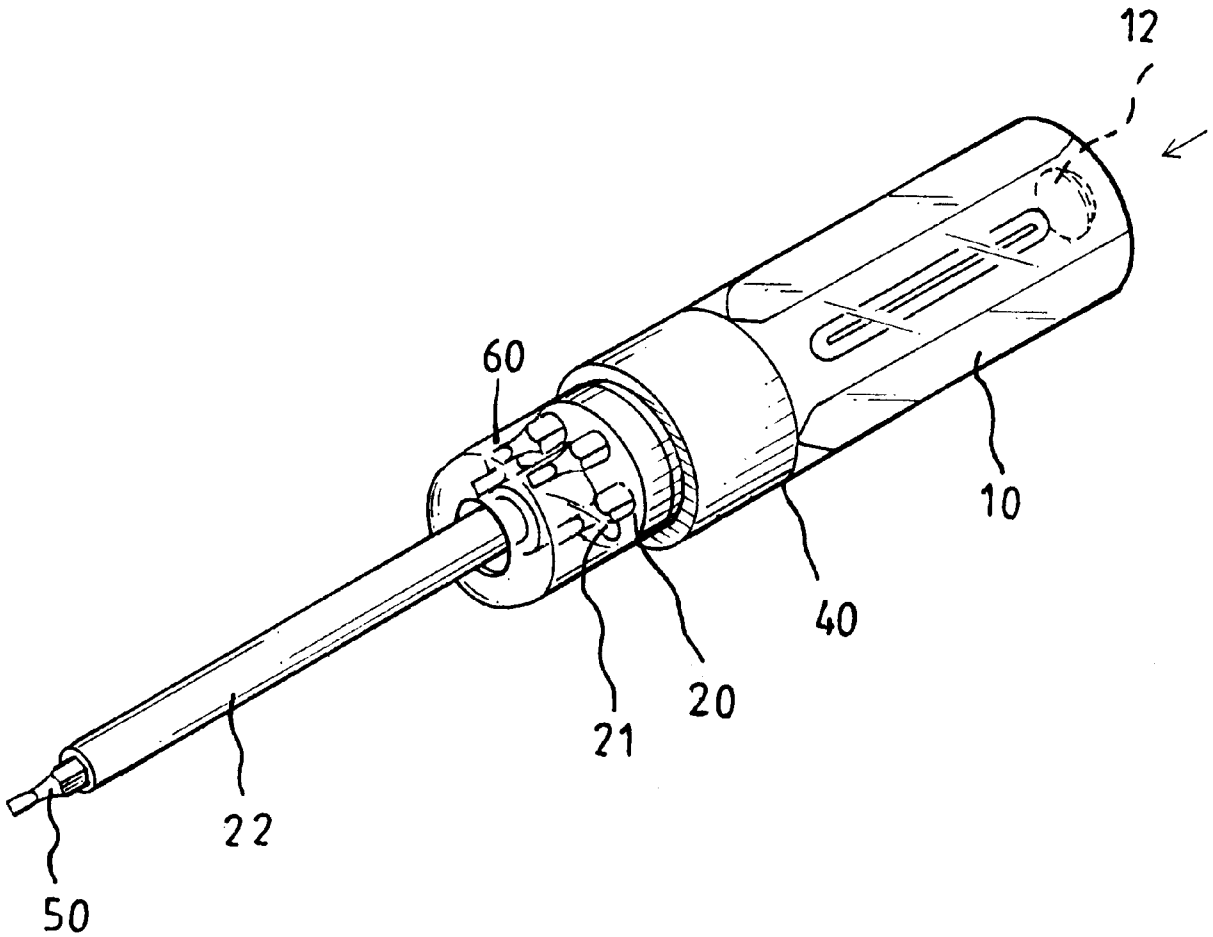
FIG. 4 is a perspective view of the present invention.
Figure 5:
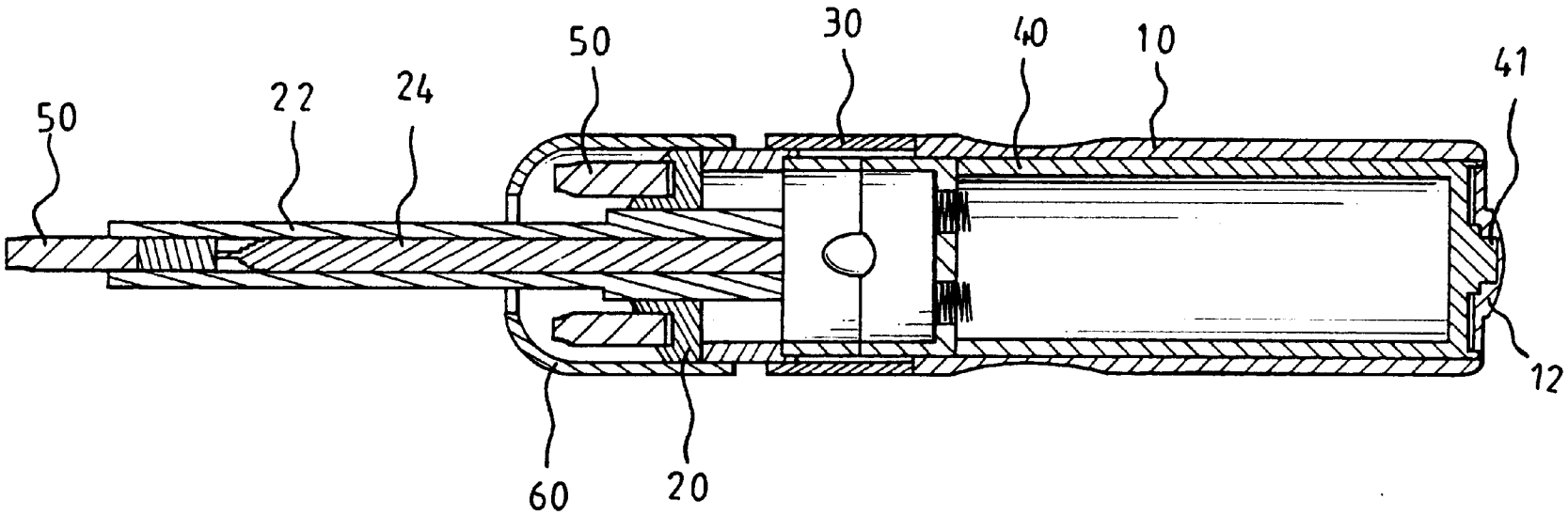
FIG. 5 is a sectional view of the present invention.

When in assembly (see FIGS. 3, 4 and 5), the flashlight 40 is first inserted into the handle 10 and an end of the collar 30 is threadedly engaged with the open end of the handle 10. Then, the seat 20 is snugly-fitted in another end of the collar 30. Thereafter, the telescopic rod 24 is fitted in the tubular rod 22 of the seat 20, with the lower end of former snugly engaged with the latter. Finally, the cover 60 is engaged with the seat 20 to prevent the bits 50 from dropping out of the seat 20.

Figure 6:
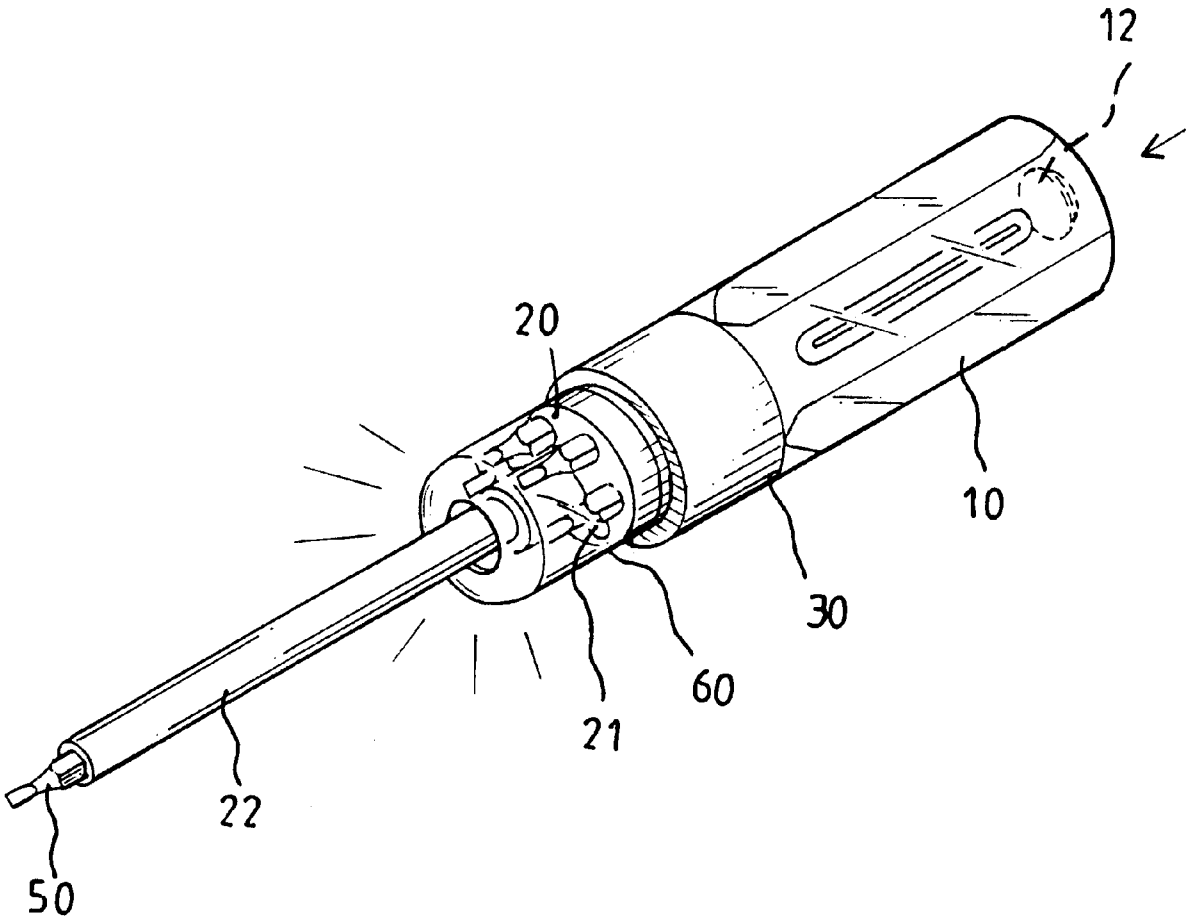
FIG. 6 illustrates a first working view of the present invention.

Referring to FIG. 6, when the rubber pad 12 is depressed, the pushbutton switch 41 of the flashlight 40 will be turned on thereby giving light for operation.

Figure 7:
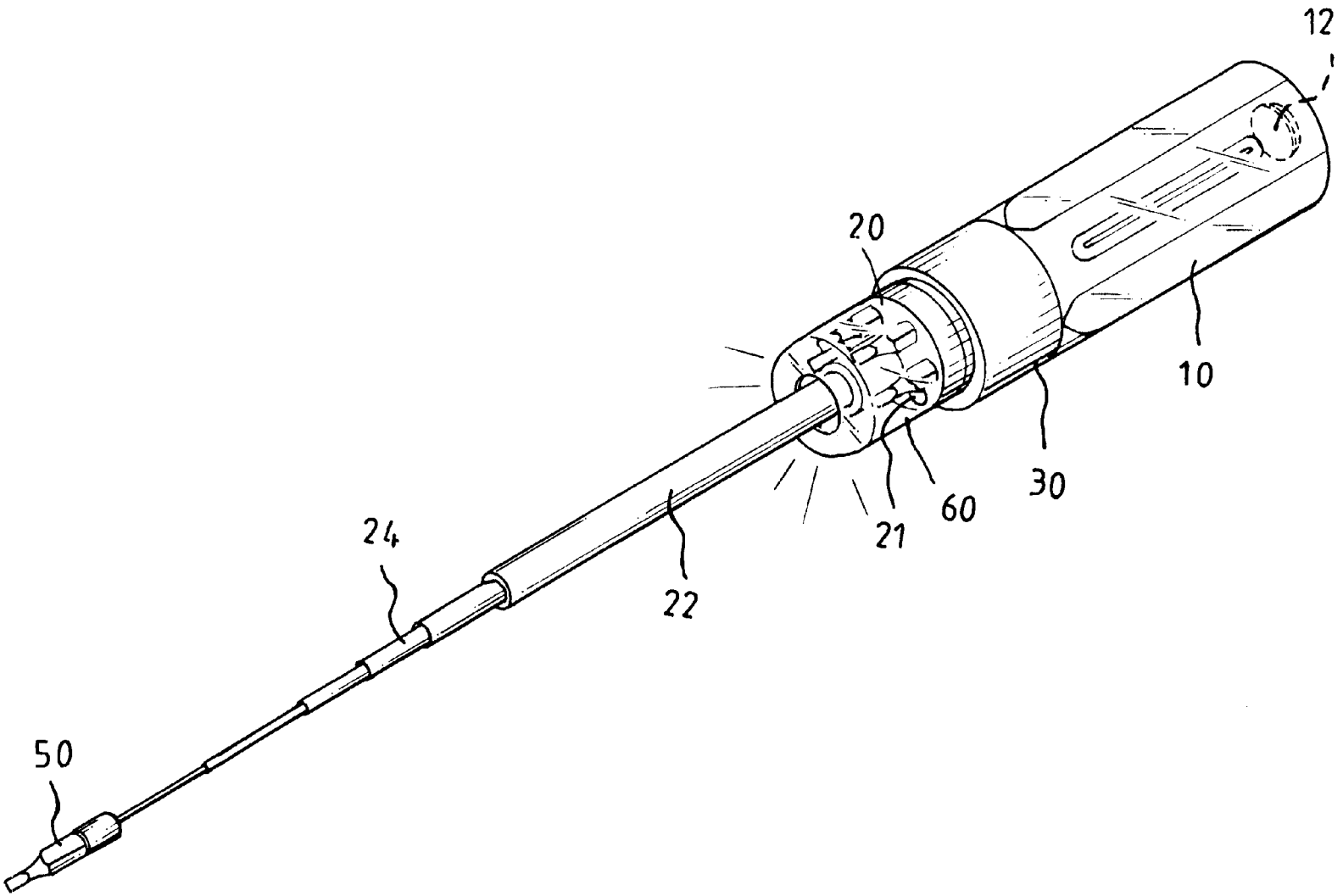
FIG. 7 illustrates a second working view of the present invention.

Referring to FIG. 7, the telescopic rod 24 may be extended to attract bits 50 dropped down on the floor.

Figure 8:
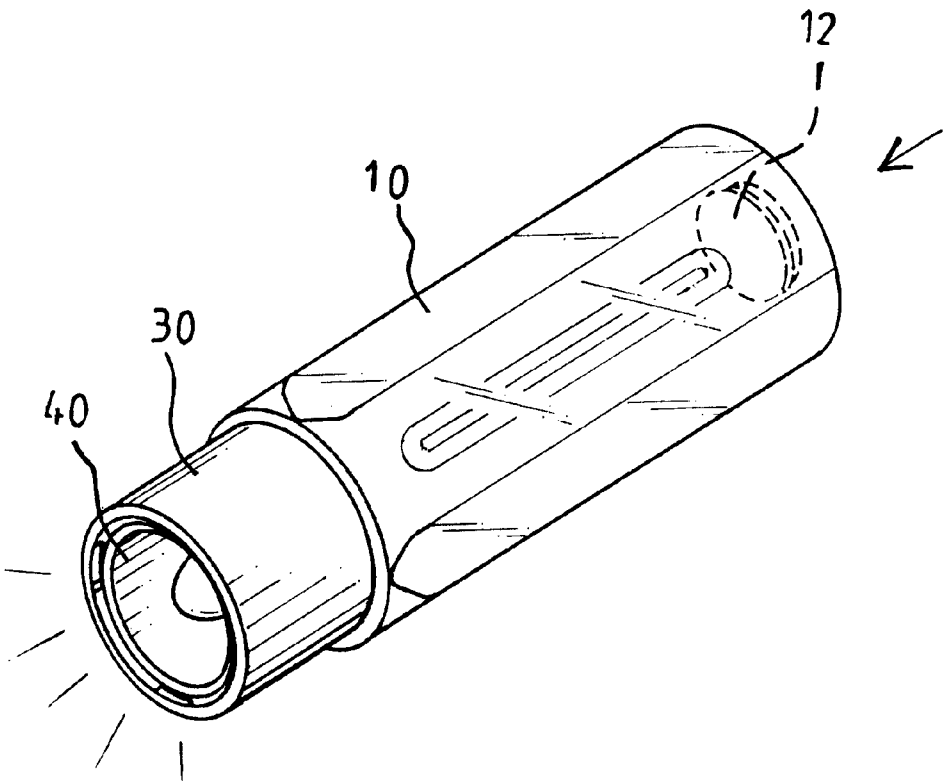
FIG. 8 illustrates a third working view of the present invention.

It should be noted, however, that the present invention could be used as a flashlight as desired (see FIG. 8).

In conclusion, the screwdriver according to the present invention has the following advantages:

1. Easy in operation;
2. Practical in use;
3. Rapid in assembly;
4. Multifunctional;
5. Simple in construction.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A screwdriver comprising:

a tubular handle having an open end provided with external threads, another end of said tubular handle having a hole in which is fitted a rubber pad;

a flashlight having an end provided with a pushbutton switch, said flashlight being arranged within said tubular handle with said pushbutton switch in contact with said rubber pad;

a collar having a first end and a second end, said first end being threadedly engaged with said external threads of said tubular handle;

a transparent cylindrical seat snugly fitted in said second end of said collar and formed with a plurality of recesses for receiving bits and a tubular rod extending from a central portion of said seat, said tubular rod having an outer end formed with a hexagonal recess configured to receive any one of said bits;

a magnetic telescopic rod fitted within said tubular rod and having a lower end snugly engaged with said tubular rod; and a cover engaged with said seat to prevent said bits from dropping out thereof.

* * * * *